US009395683B2

(12) United States Patent
Tanaka

(10) Patent No.: US 9,395,683 B2
(45) Date of Patent: Jul. 19, 2016

(54) IMAGE FORMING APPARATUS HAVING EXPOSURE DEVICE WINDBRAKE

(71) Applicant: CANON KABUSHIKI KAISHA, Tokyo (JP)

(72) Inventor: Noriaki Tanaka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/584,398

(22) Filed: Dec. 29, 2014

(65) Prior Publication Data

US 2015/0185689 A1 Jul. 2, 2015

(30) Foreign Application Priority Data

Dec. 27, 2013 (JP) ..... 2013-270657

(51) Int. Cl.

| | |
|---|---|
| ***G03G 21/00*** | (2006.01) |
| ***G03G 21/18*** | (2006.01) |
| ***G03G 21/20*** | (2006.01) |
| ***G03G 21/16*** | (2006.01) |

(52) U.S. Cl.

CPC ..... *G03G 21/1661* (2013.01); *G03G 21/1832* (2013.01); *G03G 21/206* (2013.01); *G03G 2221/1636* (2013.01)

(58) Field of Classification Search

CPC ..... G03G 2215/0897; G03G 2221/1636; G03G 2221/1645; G03G 21/1666

See application file for complete search history.

(56) References Cited

U.S. PATENT DOCUMENTS 4,540,268 A * 9/1985 Toyono ..... G03G 21/1814 399/111
4,557,586 A * 12/1985 Hayashi ..... G03G 15/04 347/135
6,463,236 B2 * 10/2002 Morikami ..... G03G 21/1619 399/121

FOREIGN PATENT DOCUMENTS

JP 10-133550 A 5/1998
JP 2002-244497 A 8/2002
JP 2011154280 A * 8/2011

* cited by examiner

*Primary Examiner* — Clayton E LaBelle
*Assistant Examiner* — Victor Verbitsky
(74) *Attorney, Agent, or Firm* — Fitzpatrick, Cella, Harper & Scinto

(57) ABSTRACT

An image forming apparatus for forming an image on a recording material includes a main assembly, and a cartridge, including an image bearing member, detachably mountable to the main assembly. The main assembly includes an exposure device for exposing a surface of the image bearing member to light, the exposure device including a light emitting surface which emits light toward the surface of the image bearing member, and a fixing device for fixing a toner image transferred on the recording material. The cartridge includes a windbreak portion projecting from the cartridge, and a width of the windbreak portion is wider than a width of the light emitting surface with respect to a longitudinal direction of the exposure device, and wherein the windbreak portion blocks air flow between the fixing device and the exposure device.

15 Claims, 16 Drawing Sheets

IMAGE FORMING APPARATUS HAVING EXPOSURE DEVICE WINDBRAKE

FIELD OF THE INVENTION AND RELATED ART

The present invention relates to an image forming apparatus for forming an image.

The image forming apparatus of an electrophotographic type electrically charges a surface of a photosensitive drum by a charging device and then exposes the charged surface of the photosensitive drum to light by an image exposure device to form an electrostatic latent image on the photosensitive drum. This electrostatic latent image is developed into a toner image by supplying a toner thereto by a developing device, and then the toner image is transferred onto a recording material by a transfer device. After the toner image formed on the surface of the photosensitive drum is transferred on the recording material, a transfer residual toner remaining on the photosensitive drum surface is removed by a cleaning device.

Then, in order to prevent image defect by eliminating an exposure history of the surface of the photosensitive drum, the surface of the photosensitive drum is irradiated with charge-removing light uniformly from an exposure device before charging, so that a residual potential is removed. Thereafter, the photosensitive drum surface is to be placed in a state in which the photosensitive drum surface can be uniformly charged again by the charging device.

When abnormality generates in the exposure device before charging, the photosensitive drum surface cannot be charged uniformly, so that the image defect generates. For that reason, Japanese Laid-Open Patent Application (JP-A) 2002-244497 proposes a technique for detecting a surface potential of a photosensitive member after irradiation with the charge-removing light in order to detect abnormality of the exposure device before charging. When the abnormality is detected, the image forming apparatus sends a warning signal.

On the other hand, the recording material on which the toner image is transferred is, after being permanently fixed on the recording material by a fixing device, discharged to an outside of the image forming apparatus. Due to downsizing and speed-up of the image forming apparatus, the fixing device and a process cartridge are provided closely to each other, and a heat quantity generated from the fixing device is also increased, so that a temperature of the process cartridge becomes high. For this reason, in some cases, the image defect and failure of the process cartridge generate. For that reason, JP-A Hei 10-133550 proposes a technique for cooling the process cartridge by forming an air path (curse) between the fixing device and the process cartridge.

A constitution of Comparison Example will be described with reference to FIGS. 15 and 16. FIG. 15 is a sectional view showing a structure of an image forming apparatus in Comparison Example. FIG. 16 is a plan view showing the structure of the image forming apparatus in Comparison Example, and is the plan view as seen from above an exposure device before charging 15. As shown in FIGS. 15 and 16, an air flow duct 16 is formed between a fixing device 9 and a process cartridge P, and a cooling air C is sent toward the process cartridge P via the air flow duct 16. At this time, the cooling air C is sent to also the exposure device before charging 15.

On the other hand, inside an image forming apparatus 1, a floating toner exists in a very small amount and is blown up in the air, thus being deposited on a light emitting surface 25 of the exposure device before charging 15. An amount of the toner deposited on the light emitting surface 25 of the exposure device 15 becomes larger with an increasing number of times of an image forming process.

When the amount of the toner deposited on the light emitting surface 25 of the exposure device before charging 15, light emission non-uniformity of the charge-removing light emitted from the light emitting surface 25 generates, so that the residual potential at the surface of the photosensitive drum 6 cannot be sufficiently removed. As a result the surface of the photosensitive drum 6 cannot be electrically charged uniformly by a charging roller 12, so that there is a possibility that the image defect generates.

SUMMARY OF THE INVENTION

The present invention has solved the above problem, and a principal object of the present invention is to provide an image forming apparatus capable of suppressing deposition of a floating matter on an exposure device by a flow of air inside an image forming apparatus main assembly.

According to an aspect of the present invention, there is provided an image forming apparatus for forming an image on a recording material, comprising: a main assembly; and a cartridge, including an image bearing member, detachably mountable to the main assembly, wherein the main assembly includes: an exposure device for exposing a surface of the image bearing member to light; and a fixing device for fixing a toner image transferred on the recording material, wherein the cartridge includes a windbreak portion projecting from the cartridge, and wherein the windbreak portion blocks an air flow from the fixing device toward the exposure device between the fixing device and the exposure device.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of an image forming apparatus according to the present invention will be described specifically with reference to the drawings.

Embodiment 1

A structure of the image forming apparatus according to the present invention in this embodiment will be described with reference to FIGS. 1 to 6.

<Image Forming Apparatus>

Figure 1:
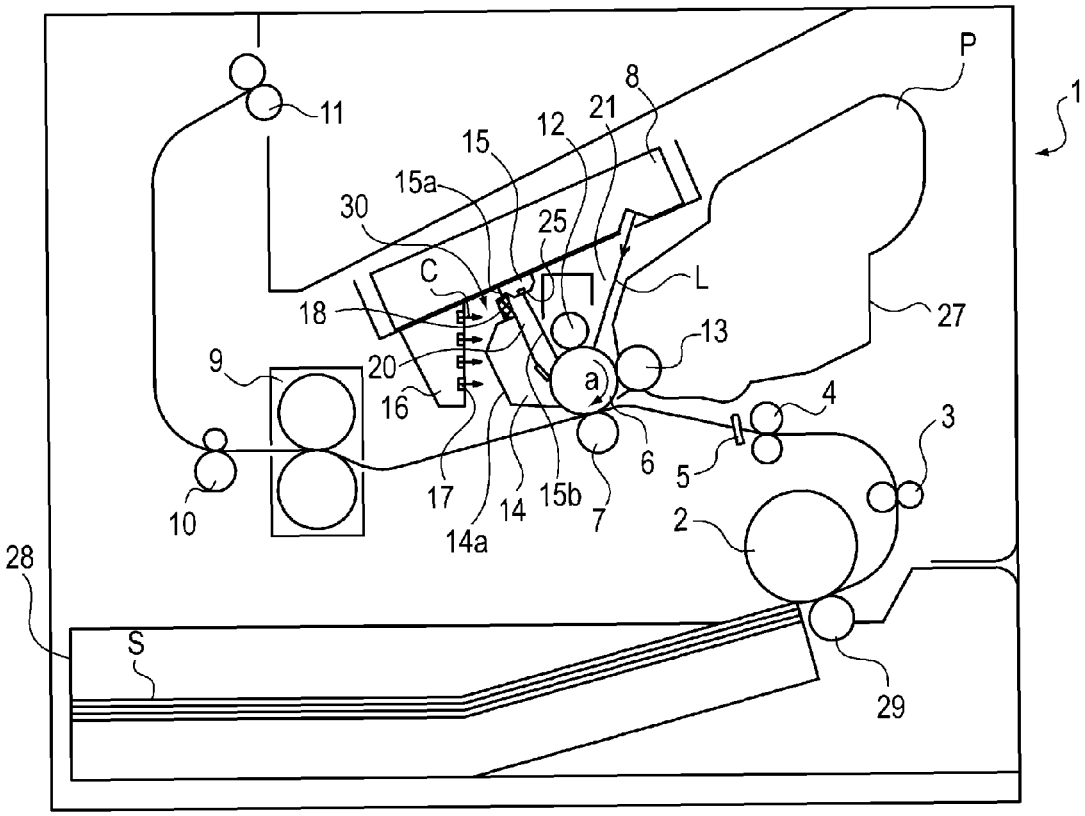
FIG. 1 is a sectional view showing a structure of an image forming apparatus according to the present invention in Embodiment 1.

A general structure of an image forming apparatus 1 in this embodiment will be described with reference to FIG. 1. FIG. 1 is a sectional view showing a structure of the image forming apparatus 1 in this embodiment. In FIG. 1, the image forming apparatus 1 in this embodiment in which an electrophotographic type is employed executes image formation on a sheet S as a recording material on the basis of an image signal inputted from an external host device such as a personal computer, an image reader or a remote facsimile machine.

On the sheet S, a toner image is formed using an electrophotographic image forming process. As the sheet S, it is possible to use, e.g., a sheet such as paper, an OHT (overhead transparency) sheet (a transparent sheet used for an OHP (overhead projector)), a label, and the like.

To a main assembly of the image forming apparatus 1, a process cartridge P as a cartridge provided with at least a developing device 27 is detachably mountable. The developing device 27 is a developing means for forming a toner image by supplying a toner as a developer to an electrostatic latent image formed on a surface of a photosensitive drum 6 as an image bearing member for bearing the electrostatic latent image.

The process cartridge P forms the toner image on the sheet S in a state in which the process cartridge P is detachably mounted in the main assembly of the image forming apparatus 1 with respect to a feeding direction (left-right direction in FIG. 1) of the sheet S. The process cartridge P in this embodiment is prepared by integrally assembling the developing device 27, the photosensitive drum 6, a charging roller 12 and a cleaning device 14 into a unit.

An image forming operation on the sheet S will be described. In FIG. 1, the sheet S stacked in a feeding cassette 28 is fed by a feeding roller 2, and then is separated and fed by a retard roller 29 to be conveyed to a conveying roller pair 3. Then, the conveying roller pair 3 conveys the sheet S to a registration roller pair 4.

Then, the sheet S passes through a sheet sensor 5 and is fed to a nip between the photosensitive drum 6 and a transfer roller 7 as a transfer means (transfer member) for transferring the toner image from the surface of the photosensitive drum 6 onto the sheet S, so that the toner image formed on the photosensitive drum 6 is transferred onto the sheet S.

The sheet S on which the toner image is transferred is fed into a fixing device 9 as a fixing means for fixing the toner image transferred on the sheet S. Then, the toner image is heated and pressed in a nip between a heating roller and a pressing roller of the fixing device 9, and thus is fixed on the sheet S.

The sheet S on which the toner image is fixed is fed to a discharging roller pair 11 by a conveying roller 10, and is discharged to an outside of the main assembly of the image forming apparatus 1 by the discharge roller pair 11.

On the other hand, an image forming process on the surface of the photosensitive drum 6 is as follows. The surface of the photosensitive drum 6 is electrically charged uniformly by the charging roller 12 as a charging means (charging member). The surface of the photosensitive drum 6 is irradiated with laser light L, in synchronism with detection timing of a leading end of the sheet S detected by the sheet sensor 5, by a laser scanner 8 as an image exposure means (image exposure device, second exposure device) for forming the electrostatic latent image on the photosensitive drum surface by exposing to light the surface of the photosensitive drum 6 charged by the charging roller 12. As a result, the electrostatic latent image is formed on the surface of the photosensitive drum 6.

The laser light L emitted from the laser scanner 8 reaches the surface of the photosensitive drum 6 through an opening 21 formed in an upper surface of the process cartridge P. The electrostatic latent image formed on the surface of the photosensitive drum 6 is developed by being supplied with the toner by a developing roller 13 provided in the developing device 27, so that the toner image is formed on the surface of the photosensitive drum 6.

The toner image on the surface of the photosensitive drum 6 is transferred onto the sheet S at the nip between the photosensitive drum 6 and the transfer roller 7. The toner residual toner which is not transferred onto the sheet S remains on the surface of the photosensitive drum 6. The transfer residual toner deposited on the surface of the photosensitive drum 6 after the toner image is transferred from the surface of the photosensitive drum 6 onto the sheet S is removed by a cleaning device 14 as a cleaning means (second cleaning member) to clean the photosensitive drum surface.

The surface of the photosensitive drum 6 is uniformly exposed to light by an exposure device before charging 15 as an exposure means (first exposure device) for removing electric charges on the surface of the photosensitive drum 6 by exposing to light the surface of the photosensitive drum 6 after the surface of the photosensitive drum 6 is cleaned by the cleaning device 14. As a result, the electric charges on the surface of the photosensitive drum 1 are removed, and the photosensitive drum 6 prepares for a subsequent charging step by the charging roller 12. The surface of the photosensitive drum 6 is exposed, through an opening 20 provided in the upper surface of the process cartridge P, to charge-removing light 15*b* emitted from a light emitting member 19 of the exposure device before charging 15 through a light emitting surface 25.

As shown in FIG. 1, in a state in which the process cartridge P is mounted in the main assembly of the image forming apparatus 1, the exposure device before charging 15 is disposed downstream of the cleaning device 14 with respect to a rotational direction, of the photosensitive drum 6, indicated by an arrow a direction in FIG. 1.

Cooling of the process cartridge P will be described. In the image forming apparatus 1 which is downsized, a temperature of the process cartridge P provided in the neighborhood of the fixing device 9 becomes high due to heat generation of the fixing device 9. For this reason, the toner in the process cartridge P is softened and melted. As a result, the image defect generates.

Figure 2:
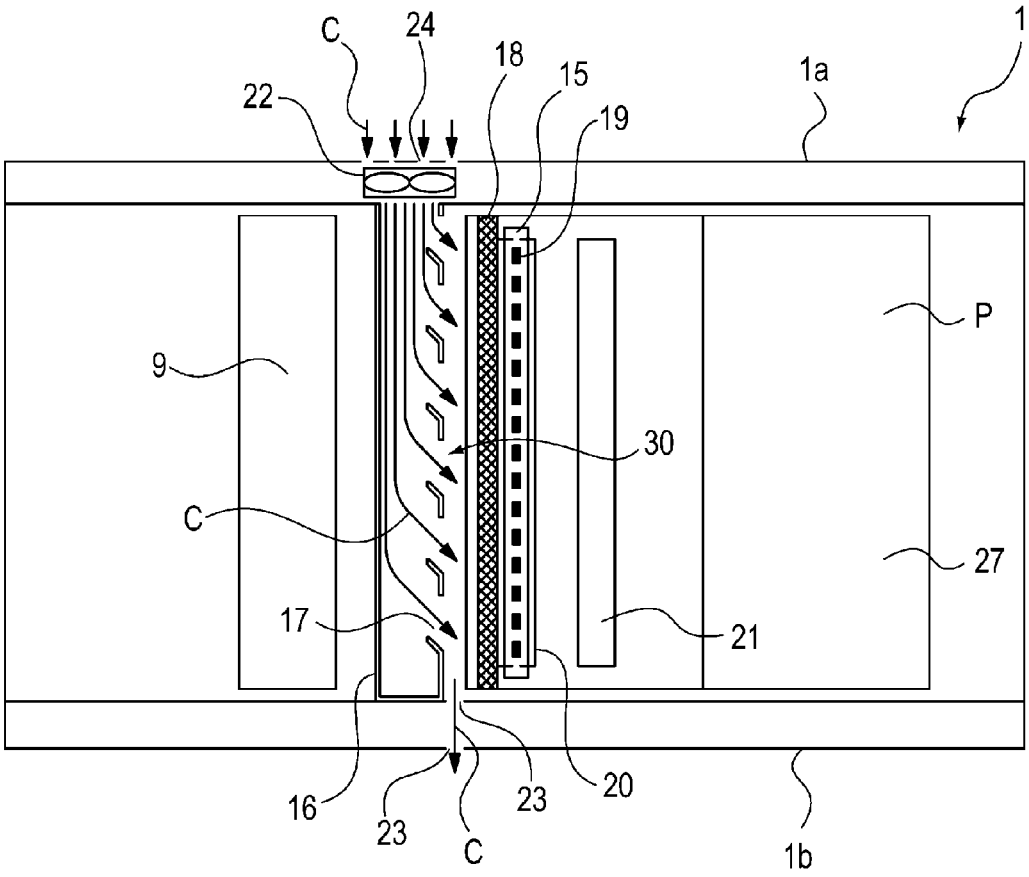
FIG. 2 is a plan view showing the structure of the image forming apparatus in Embodiment 1.

In order to prevent this phenomenon, an air flow duct 16 for sending air toward the process cartridge (cartridge) P is provided between the process cartridge P and the fixing device 9. As shown in FIG. 2, a cleaning fan 22 is provided upstream of the air flow duct 16.

As shown in FIG. 2, a fresh air inlet (suction part) 24 as a first opening through which the air is sent into an inside of the image forming apparatus 1 is provided in one side wall 1*a* of the image forming apparatus 1 between the process cartridge P and the fixing device 9. Further, an air outlet (exhaust port) 23 as a second opening through which the air is sent to an outside of the image forming apparatus 1 is provided in the other side wall 1*b* of the image forming apparatus 1 between the process cartridge P and the fixing device 9.

Then, the cleaning fan 22 is driven by an unshown controller as a control means, so that ambient air is sucked into the air flow duct (air blowing mechanism) 16 through the fresh air inlet 24 and then a cooling air C is sent toward the process cartridge P through an opening 17 of the air flow duct 16.

By disposing the air flow duct 16 between the process cartridge P and the fixing device 9, a heat insulating effect is obtained. Then, by sending toward the process cartridge P the cooling air C obtained by sucking the ambient air through the air flow duct 16, the process cartridge P can be cooled.

<Flow of Cooling Air>

Figure 3:
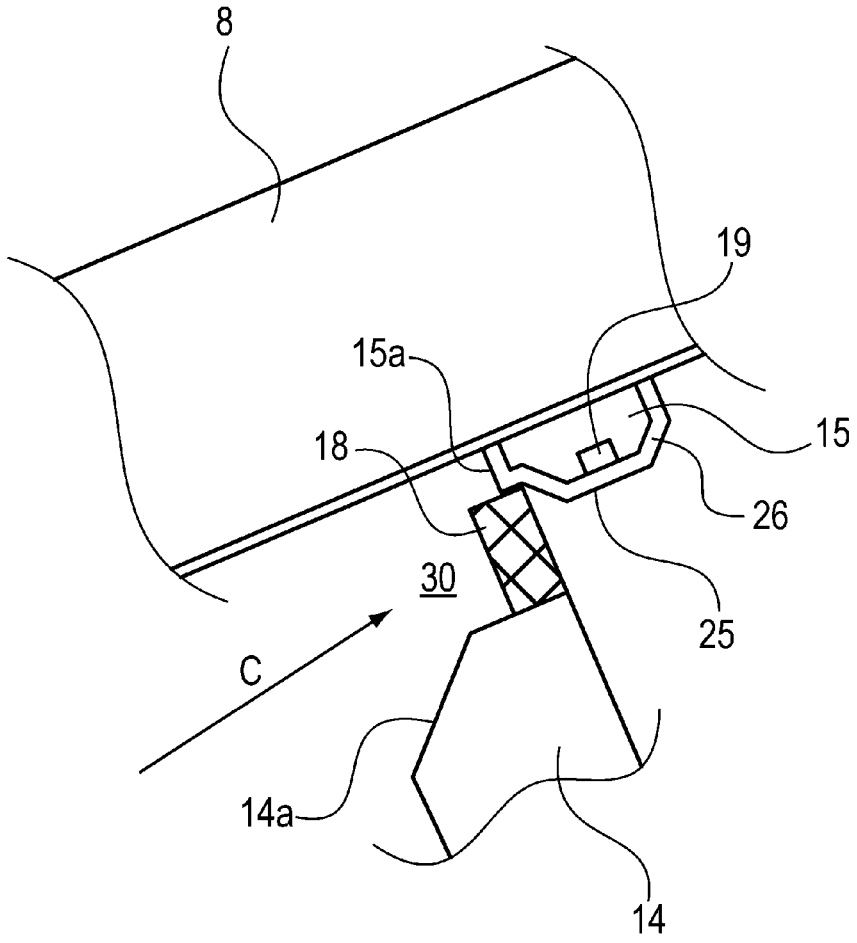
FIG. 3 is a partly enlarged view showing a positional relation between an exposure means before charging provided on a cartridge in Embodiment 1.

A flow of the cooling air C in this embodiment will be described with reference to FIGS. 2 and 3. FIG. 2 is a plan view of the image forming apparatus 1 shown in FIG. 1, and is the plan view as seen from above the exposure device before charging 15. FIG. 3 is an enlarged view showing a structure at a periphery of the exposure device before charging 15.

The exposure device before charging 15 is provided in the main assembly of the image forming apparatus 1 and includes a light emitting member 19 as a light emitting portion for exposing the surface of the photosensitive drum 6 to light. The light emitting member 19 in this embodiment is constituted by an LED (light emitting diode). The light emitting member 19 is covered with a transparent cover 26 formed of a transparent plastic or glass.

The light emitting surface 25 as the surface of the transparent cover 26 in the process cartridge (cartridge) P side has been subjected to antistatic treatment.

The cleaning fan 22 takes in the cooling air C from the outside of the main assembly of the image forming apparatus 1 and sends the cooling air C into the air flow duct 16. The cooling air C sent into the air flow duct 16 is sent through the opening 17 toward the process cartridge P.

<Cleaning Member>

A cleaning member (first cleaning member) 18 capable of cleaning the light emitting surface 25 of the light emitting member 19 in contact with the light emitting surface 25 is, as shown in FIG. 3, provided so as to project from the process cartridge P to oppose the light emitting surface 25. Further, the cleaning member 18 is disposed so as to superpose on (overlap with) the light emitting surface 25 of the exposure device before charging 15.

Figure 4:
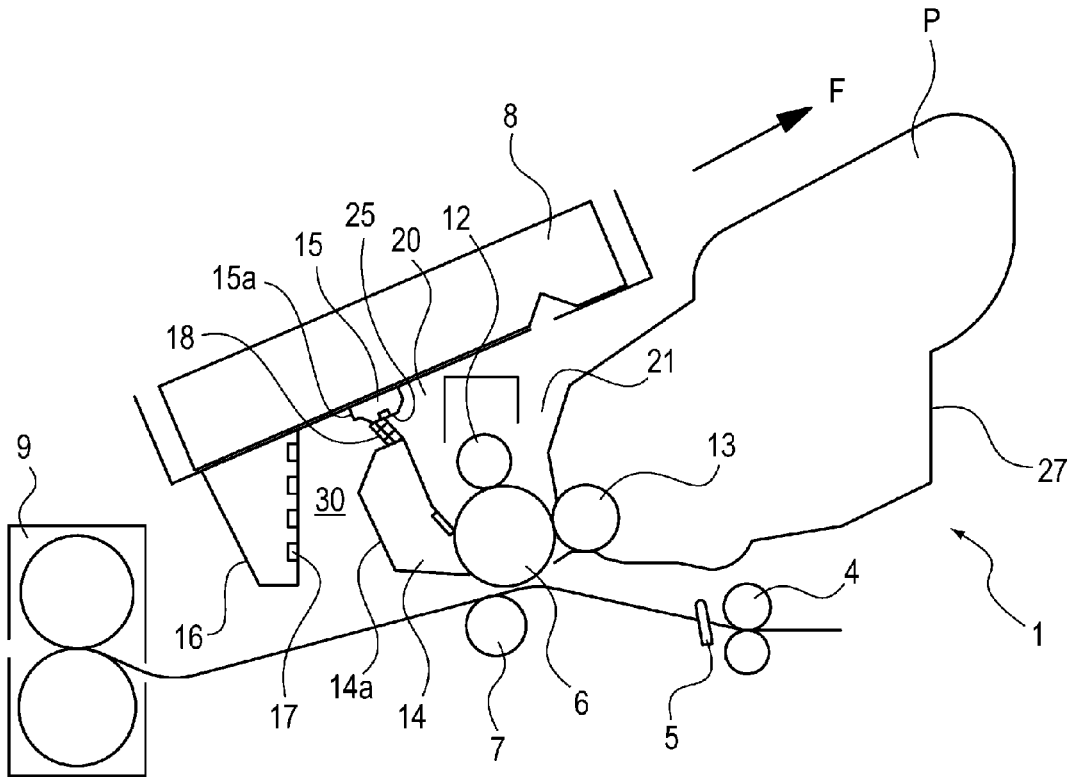
FIG. 4 is a sectional view showing a state in which the cleaning member provided on the cartridge cleans a light emitting surface of the exposure means before charging provided in the image forming apparatus main assembly with an operation of demounting the cooling air from the image forming apparatus main assembly in Embodiment 1.

As shown in FIG. 4, the cleaning member 18 is disposed as follows in a state in which the process cartridge P is mounted in the main assembly of the image forming apparatus 1. That is, between the fixing device 9 and the exposure device before charging 15, the cleaning member 18 is disposed in a position where the air flow from the fixing device 9 is not blown onto the light emitting surface 25 of the exposure device before charging 15. As a result, the cooling air C sent through the opening 17 of the air flow duct 16 is blocked by the cleaning member 18. That is, the cleaning member 18 also functions as a windbreak portion for blocking the cooling air (air flow) C.

As shown in FIGS. 2 and 4, the cooling air C sent toward the process cartridge P through the opening 17 of the air flow duct 16 is sent along an air path (course) 30, and then is sent to the outside of the main assembly of the image forming apparatus 1 through an air outlet (exhaust port) 23 as a second opening. The air path 30 is formed by the air flow duct 16, an outer peripheral wall surface 14*a* of the cleaning device 14 of the process cartridge P, the cleaning member 18 and an outer peripheral wall surface 15*a* of the exposure device before charging 15.

Figure 5:
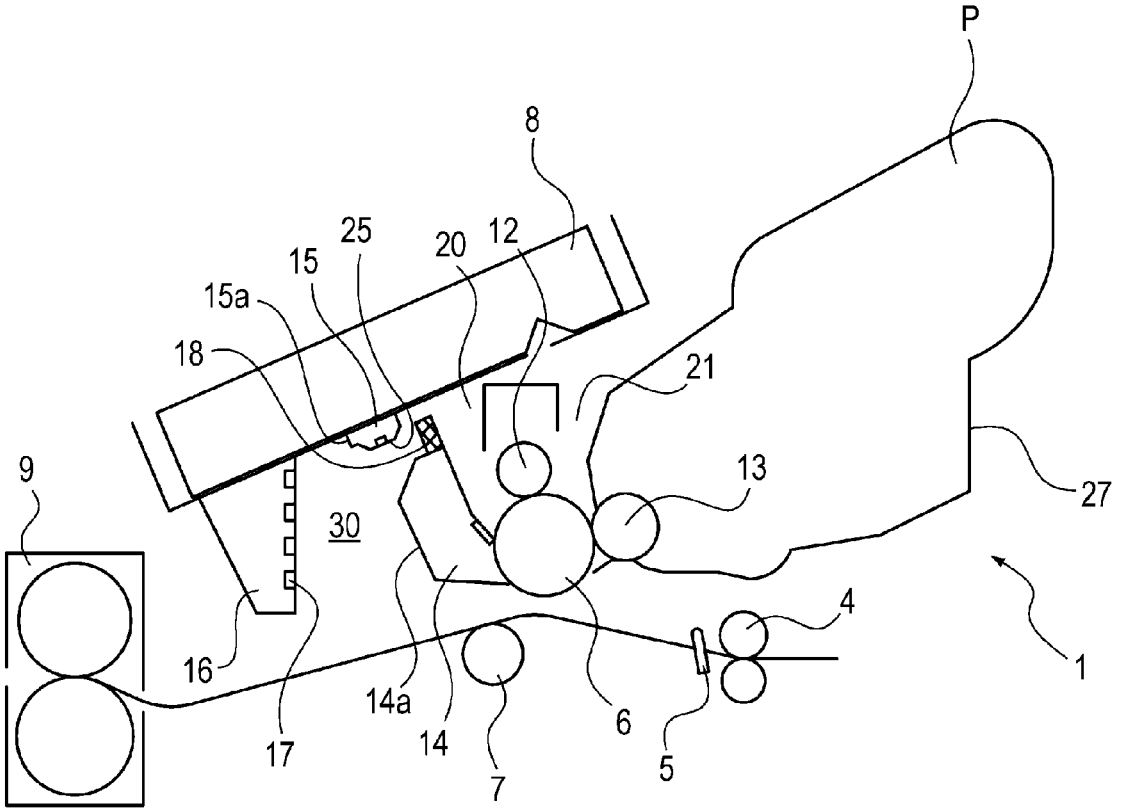
FIG. 5 is a sectional view showing a state in which the cartridge is demounted in the image forming apparatus in Embodiment 1.
Figure 6:
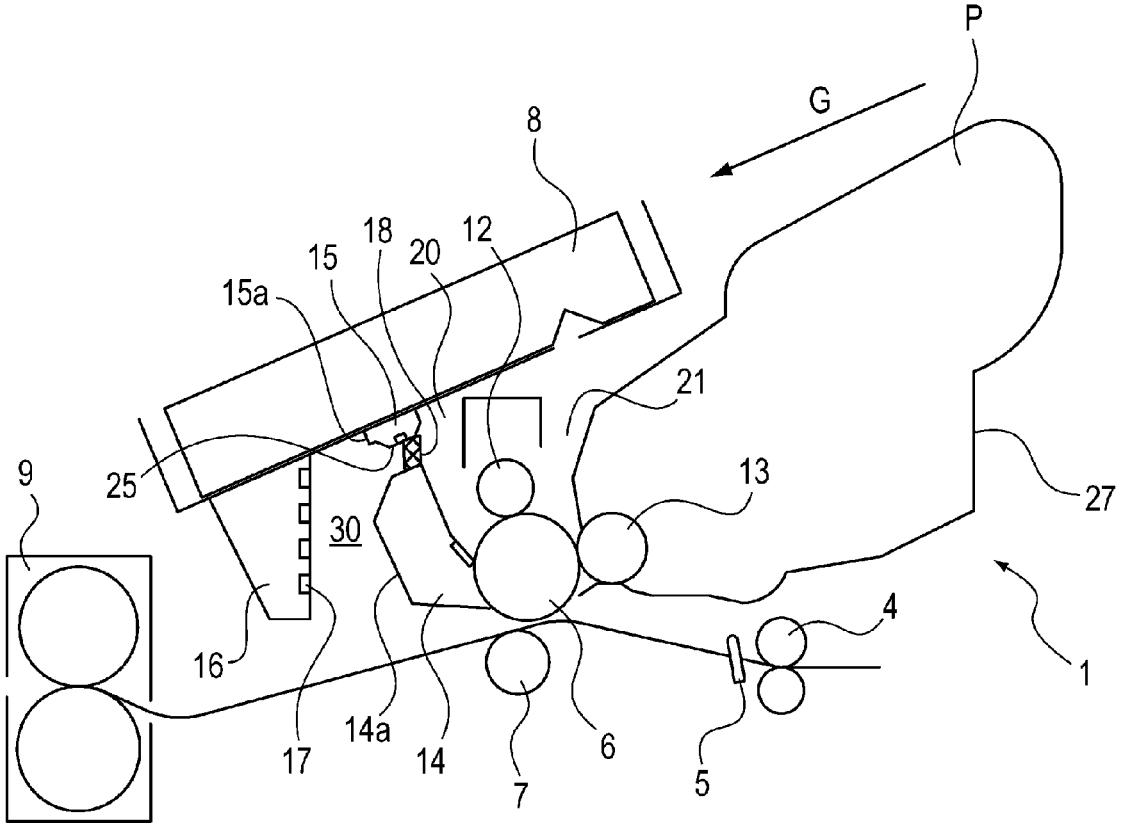
FIG. 6 is a sectional view showing a state in which the cleaning member provided on the cartridge cleans a light emitting surface of the exposure means before charging provided in the image forming apparatus main assembly with an operation of mounting the cooling air from the image forming apparatus main assembly in Embodiment 1.

Next, with reference to FIGS. 4 to 6, an operation for cleaning the light emitting surface 25 of the exposure device before charging 15 fixed in the main assembly of the image forming apparatus 1 by wiping the light emitting surface 25 with the cleaning member 18 provided on and projects from an upper surface of the outer peripheral wall surface 14*a* of the cleaning device 14 of the process cartridge P so as to be elastically deformable will be described. FIGS. 4 to 6 are sectional views showing a constitution in which the process cartridge P is mounted into and demounted from the main assembly of the image forming apparatus 1 in this embodiment.

FIG. 4 shows a state in which an operation for demounting the process cartridge P from the main assembly of the image forming apparatus 1 is performed partway. The process cartridge P is pulled out during jam clearance of the sheet S or during exchange of the process cartridge P. As shown in FIG. 4, the process cartridge P is pulled out in an arrow F direction which is a demounting direction in FIG. 4. At this time, as shown in FIG. 4, the cleaning member 18 provided integrally with the process cartridge P is contacted to and slid across the light emitting surface 25 of the exposure device before charging 15 fixed in the main assembly of the image forming apparatus 1. When the process cartridge P is further pulled out in the arrow F direction, the process cartridge P is moved to a position shown in FIG. 5, so that wiping cleaning of the light emitting surface 25 by the cleaning member 18 is ended.

Next, the mounting of the process cartridge P will be described with reference to FIG. 6. The process cartridge P is moved from the position shown in FIG. 5 to a position shown in FIG. 6, so that the cleaning member 18 mounted integrally with the process cartridge P is contacted to and slid across the light emitting surface 25 of the exposure device before charging 15 fixed in the main assembly of the image forming apparatus 1. When the process cartridge P is further pushed in an arrow G direction, the process cartridge P is mounted in the position shown in FIG. 1.

In general, a lifetime of the process cartridge P is shorter than a lifetime of the image forming apparatus 1. For this reason, at least in a period in which the lifetime of the process cartridge P reaches an end thereof, the light emitting surface 25 of the exposure device before charging 15 fixed in the main assembly of the image forming apparatus 1 can be wiped and cleaned at least two times by the cleaning member 18 mounted integrally with the process cartridge P.

Further, the cleaning member 18 can be constituted by a foamed plastic material, a rubber material, a brush material or the like. The cleaning member 18 can also be constituted by an antistatic material, an electroconductive material or the like.

For example, the cleaning member 18 can be constituted by polyethylene foam, electroconductive polystyrene foam, electroconductive polypropylene foam, silicone rubber or the like. Further, the cleaning member 18 can be constituted by electroconductive silicone rubber, EPDM (ethylene propylene diene terpolymer (rubber)), electroconductive EPDM, fiber brush, electroconductive fiber brush or the like.

Further, the transparent cover 26 covering the light emitting surface 25 is constituted by a plastic material having an antistatic performance or has been subjected to antistatic treatment at a surface opposing the cleaning member 18. As an example of the antistatic treatment, an antistatic agent based on a surfactant, a polymer or a silicone is applied onto the transparent cover 26.

According to this embodiment, as shown in FIG. 1, in the state in which the process cartridge P is mounted in the main assembly of the image forming apparatus 1, the following effect is obtained. The cooling air C blown through the opening 17 of the air flow duct 16 is blocked by the outer peripheral wall surface 15*a* of the exposure device before charging 15, the cleaning member 18 and the outer peripheral wall surface 14*a* of the cleaning device 14 of the process cartridge P. As a result, the cooling air C does not reach the light emitting surface 25 of the exposure device before charging 15. As a result, the floating toner existing in the main assembly of the image forming apparatus 1 is prevented from being blown up in the air by the cooling air C, so that the floating toner is not deposited on the light emitting surface 25 of the exposure device before charging 15.

Further, in interrelation with the mounting and demounting operation of the process cartridge P relative to the main assembly of the image forming apparatus 1, the cleaning member 18 mounted integrally with the process cartridge P is contacted to and slid with the light emitting surface 25 of the exposure device before charging 15 fixed in the main assembly of the image forming apparatus 1 to wipe and clean the light emitting surface 25. As a result, even when the floating toner is deposited on the light emitting surface 25 of the exposure device before charging 15, the floating toner can be cleaned and removed by the cleaning member 18. The floating toner transferred on the cleaning member 18 is removed to the outside of the image forming apparatus 1 together with the exchange of the process cartridge P.

As a result, light emission non-uniformity of the charge-removing light 15*b* emitted from the light emitting surface 25 of the exposure device before charging 15 can be prevented with an inexpensive constitution, so that it is possible to provide a maintenance-free image forming apparatus 1.

Embodiment 2

A constitution of an image forming apparatus according to the present invention in Embodiment 2 will be described with reference to FIGS. 7 to 9. Members or portions constituted similarly as those in Embodiment 1 are represented by the same reference numerals or symbols or the same member (portion) means even when the number or symbols are different, and will be omitted from description.

Figure 7:
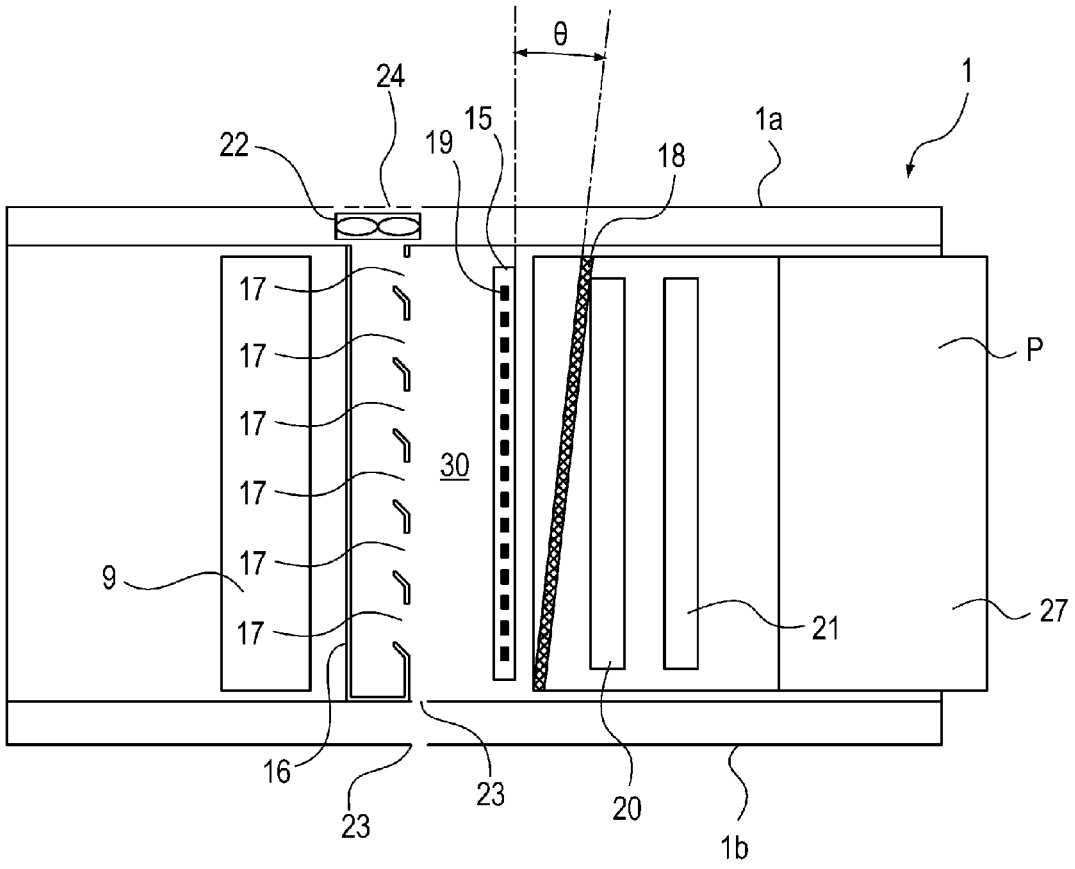
FIG. 7 is a plan view showing a state in which a cartridge is demounted in an image forming apparatus according to the present invention in Embodiment 2.
Figure 8:
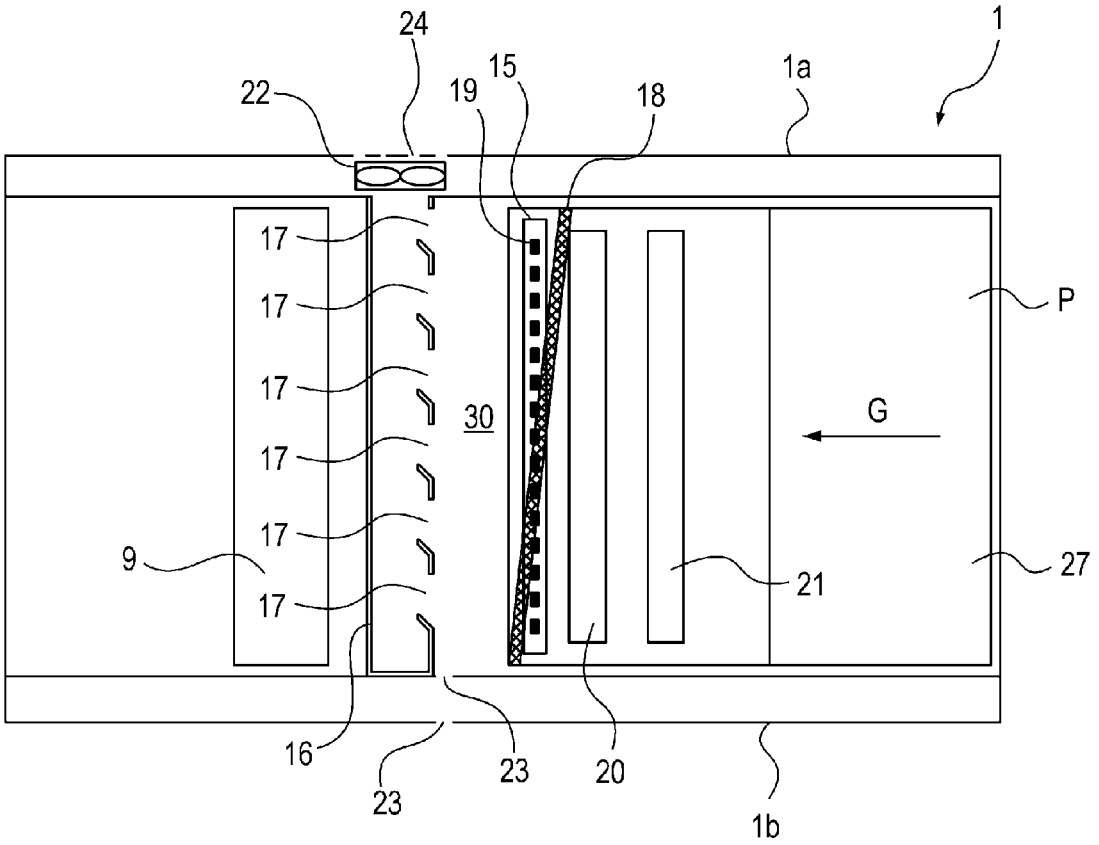
FIG. 8 is a plan view showing a state in which the cleaning member provided on the cartridge cleans a light emitting surface of the exposure means before charging provided in the image forming apparatus main assembly with an operation of mounting the cooling air from the image forming apparatus main assembly in Embodiment 1.
Figure 9:
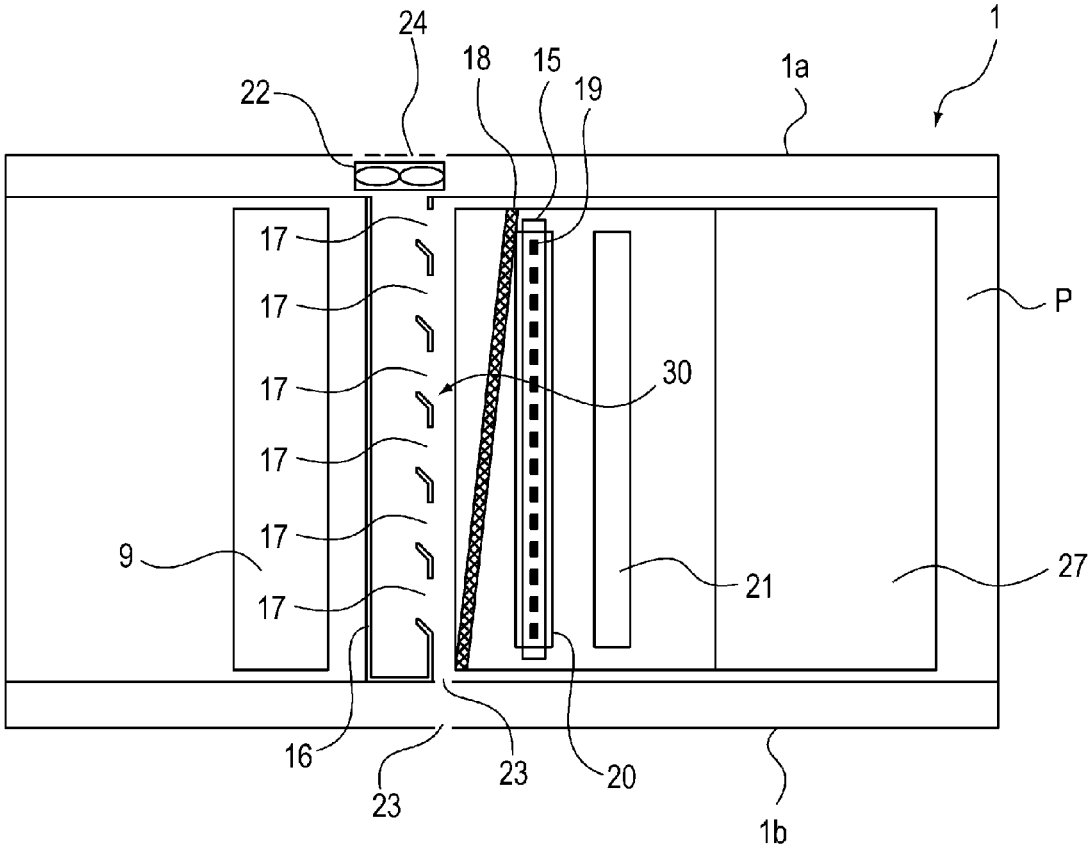
FIG. 9 is a plan view showing a state in which the cartridge is mounted in the image forming apparatus in Embodiment 2.

With reference to FIGS. 7 to 9, a mounting constitution of the cleaning member 18 of the process cartridge P in this embodiment will be described. FIGS. 7 to 9 are plan views showing a structure of the image forming apparatus 1 in this embodiment, and are the plan views as seen from above the exposure device before charging 15.

In Embodiment 1, as shown in FIG. 2, the longitudinal direction (up-down direction in FIG. 2) of the cleaning member 18 and the longitudinal direction (up-down direction in FIG. 2) of the light emitting surface 25 of the exposure device before charging 15 were disposed substantially in parallel to each other. As a result, a constitution in which the cleaning member 18 was contacted substantially simultaneously to the entirety of the light emitting surface 25 with respect to the longitudinal direction during the cleaning of the light emitting surface 25 was employed.

In this embodiment, as shown in FIG. 7, the longitudinal direction (from upper-right portion to a lower-left portion in FIG. 7) of the cleaning member 18 and the longitudinal direction (up-down direction in FIG. 7) of the light emitting surface 25 of the exposure device before charging 15 were disposed at a predetermined crossing angle θ.

As a result, in interrelation with the mounting and demounting operation of the process cartridge P relative to the main assembly of the image forming apparatus 1, the cleaning member 18 mounted integrally with the process cartridge P is contacted to and slid across the light emitting surface 25 of the exposure device before charging 15 fixed in the main assembly of the image forming apparatus 1 to wipe and clean the light emitting surface 25. At that time, as shown in FIG. 8, a constitution in which the cleaning member 18 is contacted to the entirety of the light emitting surface 25 with respect to the longitudinal direction (up-down direction in FIG. 7) during the cleaning of the light emitting surface 25 with a time difference.

In this embodiment, as shown in FIG. 7, the cleaning member 18 is disposed obliquely to the light emitting surface 25 of the exposure device before charging 15. From the state shown in FIG. 7, the process cartridge P is gradually moved in the mounting direction shown as an arrow G direction in FIG. 8. Thus, as shown in FIG. 8, a longitudinal part of the light emitting surface 25 of the exposure device before charging 15 and a longitudinal part of the obliquely disposed cleaning member 18 are moved while being successively contacted to each other from one longitudinal end portion (lower end portion in FIG. 8). Then, the longitudinal part of the cleaning member 18 is contacted to the entirety of the light emitting surface 25 with respect to the longitudinal direction (up-down direction in FIG. 8) until the other longitudinal end portion (upper end portion of FIG. 8) with the time difference, so that the light emitting surface 25 is wiped and cleaned by the cleaning member 18.

The process cartridge P is further moved to the mounting position in FIG. 9. As in this embodiment, the cleaning member 18 is disposed obliquely to the light emitting surface 25 of the exposure device before charging 15. As a result, a sliding resistance when the light emitting surface 25 is cleaned by the cleaning member can be reduced, with the result that it is possible to reduce a resistance during the mounting and demounting of the process cartridge P. Other constitutions are the same as those in Embodiment 1, and a similar effect can be obtained.

Embodiment 3

Figure 10:
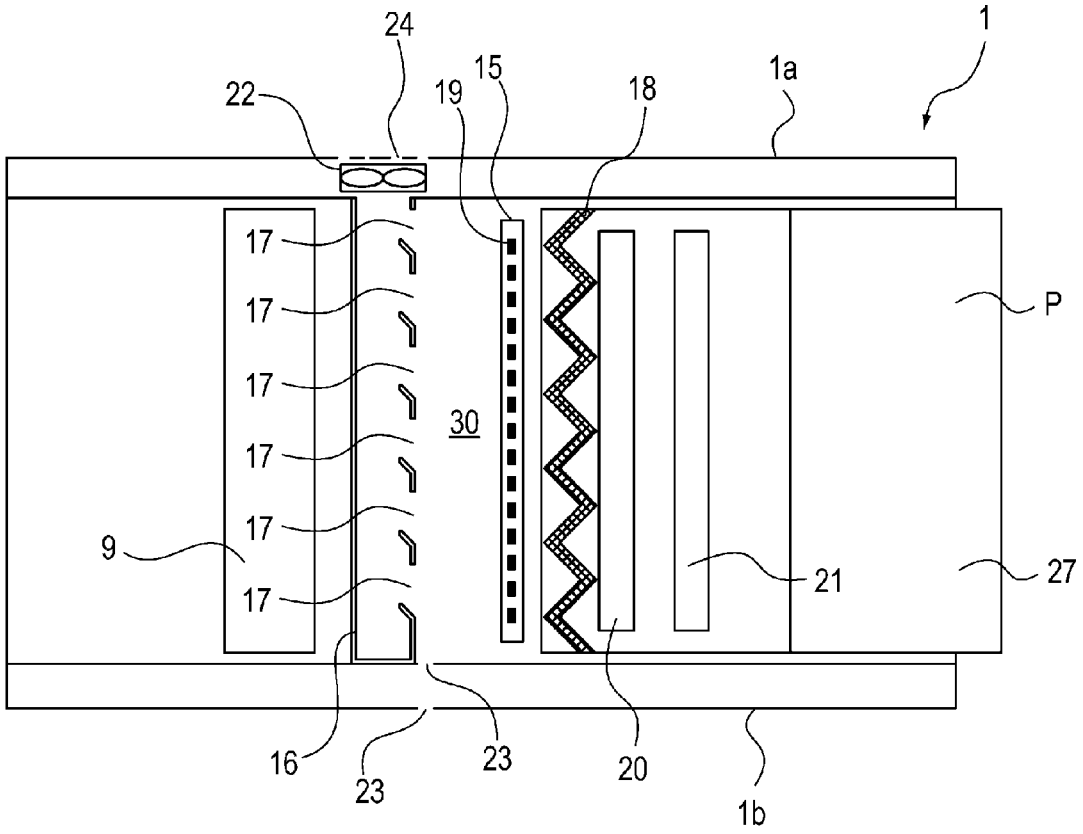
FIG. 10 is a plan view showing a state in which a cartridge is demounted in an image forming apparatus according to the present invention in Embodiment 3.

A constitution of an image forming apparatus according to the present invention in Embodiment 3 will be described with reference to FIG. 10. Members or portions constituted similarly as those in Embodiments 1 and 2 are represented by the same reference numerals or symbols or the same member (portion) means even when the number or symbols are different, and will be omitted from description. In this embodiment, the cleaning member 18 was disposed obliquely to the light emitting surface 25 of the exposure device before charging 15. In this embodiment, the cleaning member 18 was formed in a zigzag shape along the longitudinal direction (up-down direction in FIG. 10. The zigzag shape is a shape such that a rectilinear line is bent many times in a Z-character shape as shown in FIG. 10.

Also in this embodiment, in interrelation with the mounting and demounting operation of the process cartridge P relative to the main assembly of the image forming apparatus 1, the cleaning member 18 mounted integrally with the process cartridge P is moved. Then, the cleaning member 18 is contacted to and slid with the light emitting surface 25 of the exposure device before charging 15 fixed in the main assembly of the image forming apparatus 1 to wipe and clean the light emitting surface 25.

At that time, a constitution in which the zigzag-shaped cleaning member 18 was contacted to the entirety of the light emitting surface 25 with respect to the longitudinal direction during the cleaning of the light emitting surface 25 with a time difference corresponding to the zigzag shape was employed. As a result, a mounting resistance of the process cartridge P can be reduced.

Other than the zigzag shape, the shape of the cleaning member 18 may also be constituted of a wavy shape in which an S-character shape continues along the longitudinal direction. Also in this case, a constitution in which the cleaning member 18 is contacted to the entirety of the light emitting surface 25 with respect to the longitudinal direction during the cleaning of the light emitting surface 25 with the time difference corresponding to the zigzag shape can be employed. Other constitutions are the same as those in Embodiments 1 and 2, and a similar effect can be obtained.

Embodiment 4

A constitution of an image forming apparatus according to the present invention in Embodiment 4 will be described with reference to FIGS. 11 and 12.

Members or portions constituted similarly as those in Embodiments 1 to 3 are represented by the same reference numerals or symbols or the same member (portion) means even when the number or symbols are different, and will be omitted from description.

In Embodiments 1 to 3, in the state in which the process cartridge P was mounted in the main assembly of the image forming apparatus 1, the air flow duct 16 through which the air was sent was provided between the process cartridge P and the fixing device 9.

Figure 11:
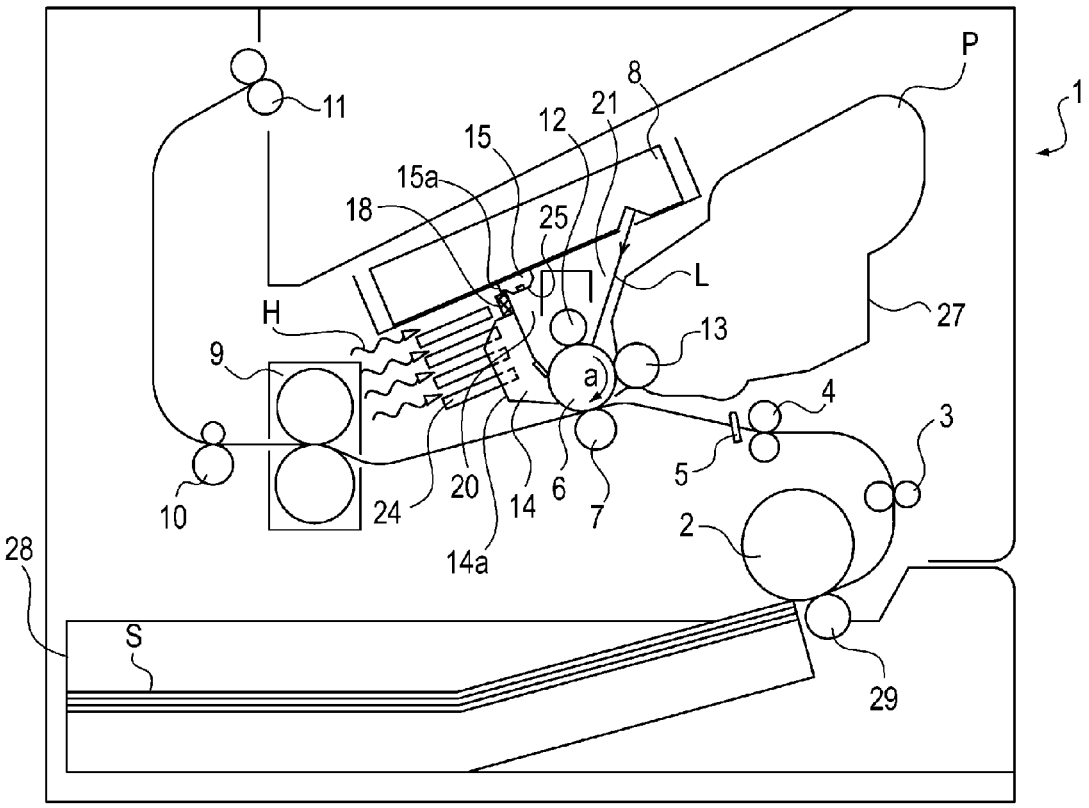
FIG. 11 is a sectional view showing a structure of an image forming apparatus according to the present invention in Embodiment 4.
Figure 12:
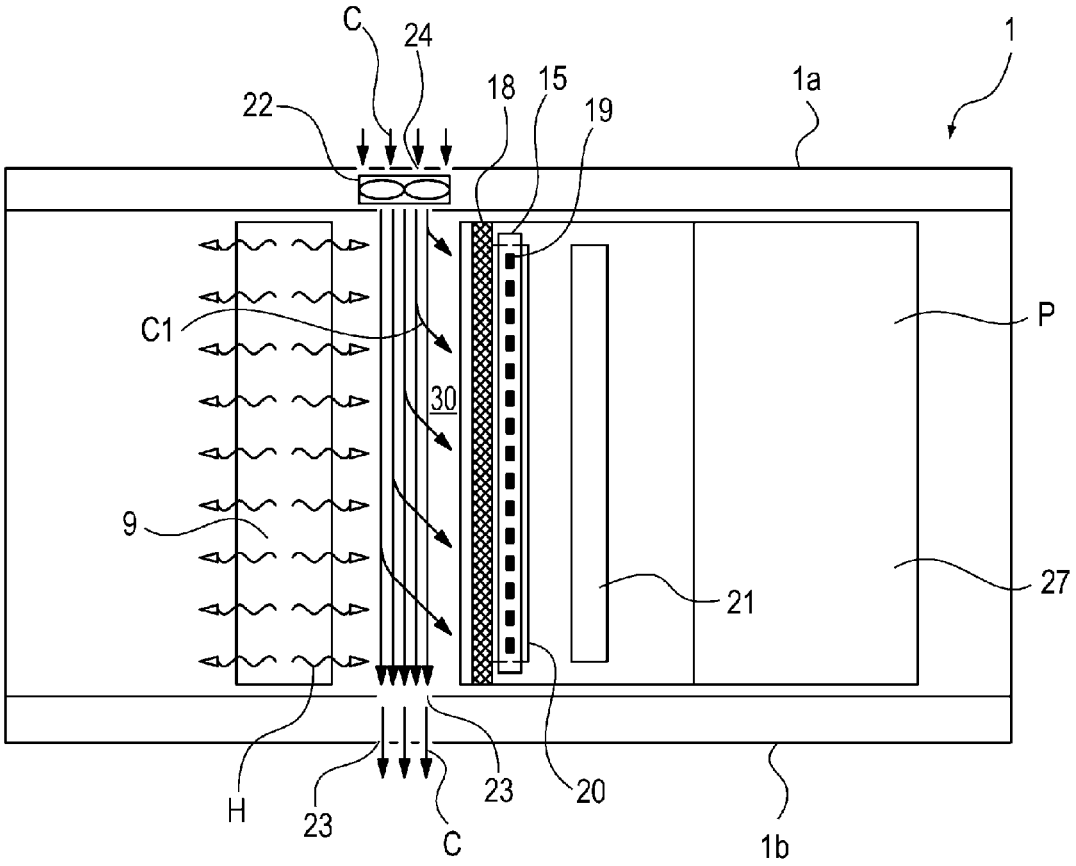
FIG. 12 is a plan view showing the structure of the image forming apparatus in Embodiment 4.

In this embodiment, as shown in FIGS. 11 and 12, the air flow duct 16 is omitted, and the fresh air inlet (suction port) 24 as the first opening through which the air is sent into the main assembly of the image forming apparatus 1 is provided in one side wall 1*a* of the main assembly of the image forming apparatus 1 between the process cartridge P and the fixing device 9. Further, the air outlet (exhaust port) 23 as the second opening through which the air is sent to the outside of the main assembly of the image forming apparatus 1 is provided in the other wide wall 1*b* of the main assembly of the image forming apparatus 1 so as to be opposed from the fresh air inlet 24.

In the case where the process cartridge P is cooled in this embodiment, the cooling air C is taken in from the outside of the main assembly of the image forming apparatus 1 by the cleaning fan 22 provided in the one side wall 1*a* of the main assembly of the image forming apparatus 1. Then, the cooling air C is sent into the main assembly of the image forming apparatus 1 toward the air outlet 23 through the fresh air inlet 24 provided in the side wall 1*a* of the image forming apparatus 1. Most of the sent cooling air C passes through the air outlet 23 and is sent to the outside of the main assembly of the image forming apparatus 1.

By sending the cooling air C toward the air outlet 23 through the fresh air inlet 24, the heat moved from the fixing device 9 toward the process cartridge P is insulated. Further, a part C1 of the cooling air C sent through the fresh air inlet 24 is changed in flow direction toward the process cartridge P by warm air H or the like sent from the fixing device 9, and flows toward also the process cartridge P.

However, also in this embodiment, as shown in FIG. 11, in the state in which the process cartridge P is mounted in the main assembly of the image forming apparatus 1, the following effect is obtained. The part C1 of the cooling air C changed in direction toward the process cartridge P is blocked by the outer peripheral wall surface 15*a* of the exposure device before charging 15, the cleaning member 18 and the outer peripheral wall surface 14*a* of the cleaning device 14 of the process cartridge P. Further, the part C1 of the cooling air C does not reach the light emitting surface 25 of the exposure device before charging 15. As a result, the floating toner existing in the main assembly of the image forming apparatus 1 is prevented from being blown up in the air by the part C1 of the cooling air C, so that the floating toner is not deposited on the light emitting surface 25 of the exposure device before charging 15.

As shown in FIG. 11, the cleaning member 18 in this embodiment is disposed so that the cleaning member 18 contacts the outer peripheral wall surface 15*a* of the exposure device before charging 15 and is superposed on (overlaps with) the light emitting surface 25. For this reason, the part C1 of the cooling air C is blocked by the cleaning member 18. Other constitutions are the same as those in Embodiments 1 to 3, and a similar effect can be obtained.

Embodiment 5

A constitution of an image forming apparatus according to the present invention in Embodiment 5 will be described with reference to FIGS. 13 and 14. Members or portions constituted similarly as those in Embodiments 1 to 4 are represented by the same reference numerals or symbols or the same member (portion) means even when the number or symbols are different, and will be omitted from description.

In Embodiments 1 to 4, the constitution in which the process cartridge P was cooled by forcedly introducing the cooling air C from the outside of the main assembly of the image forming apparatus 1 by the cleaning fan 22 provided in the side wall 1*a* of the main assembly of the image forming apparatus 1. In this embodiment, as shown in FIGS. 13 and 14, the cleaning 22 is omitted and a constitution in which the process cartridge P is naturally cooled by air flow naturally generating in the main assembly of the image forming apparatus 1 is employed.

The nip of the fixing device 9 is heated for fixing the toner image transferred on the sheet S. As a result, the fixing device 9 itself warms. For that reason, as shown in FIG. 13, air flow consisting of the warm air H sent from the fixing device 9 and an upward air J generated by a temperature difference in the main assembly of the image forming apparatus 1 generates. A part H1 of the warm air H sent from the fixing device 9 flows toward also the process cartridge P.

Figure 13:
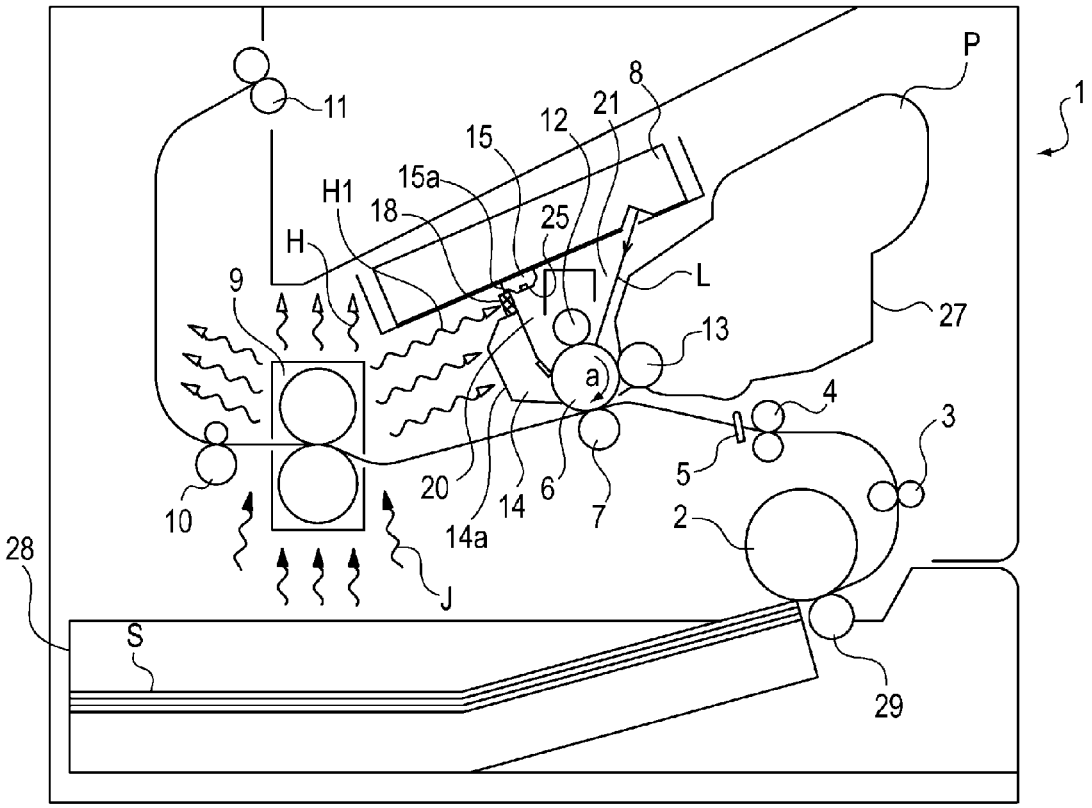
FIG. 13 is a sectional view showing a structure of an image forming apparatus according to the present invention in Embodiment 5.
Figure 14:
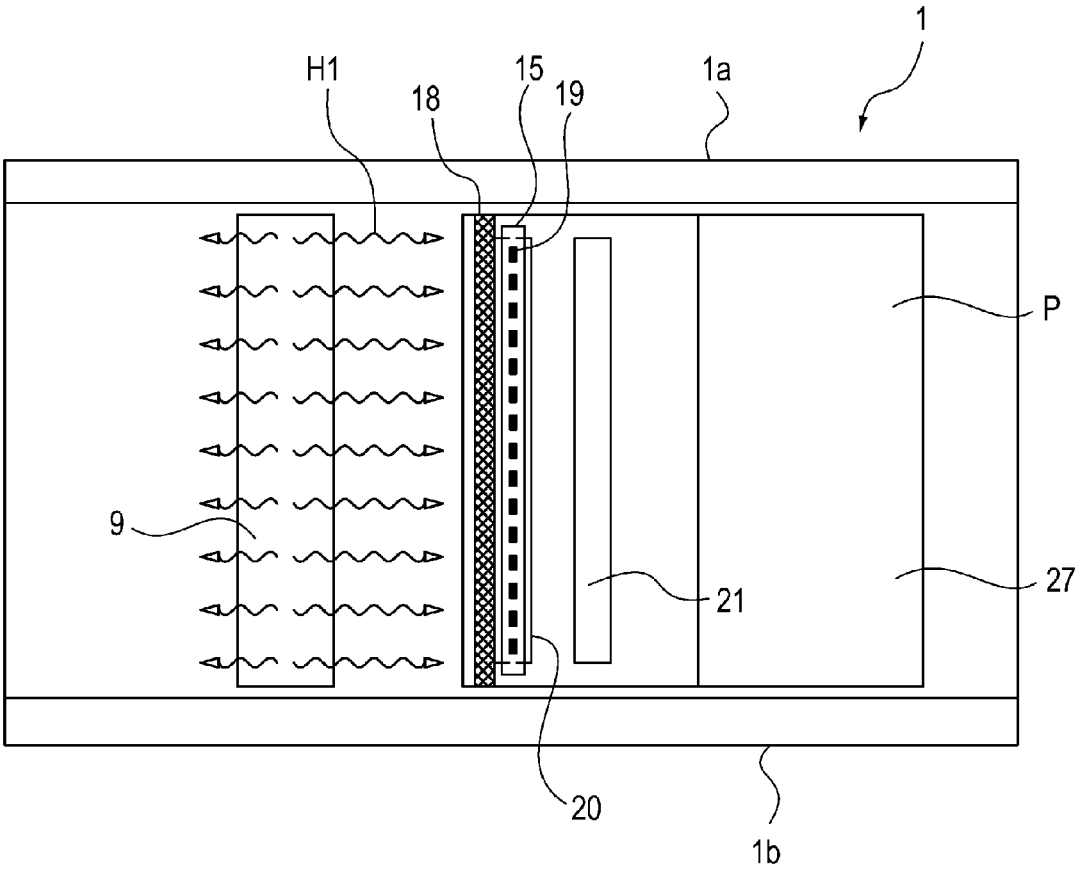
FIG. 14 is a plan view showing the structure of the image forming apparatus in Embodiment 5.
Figure 15:
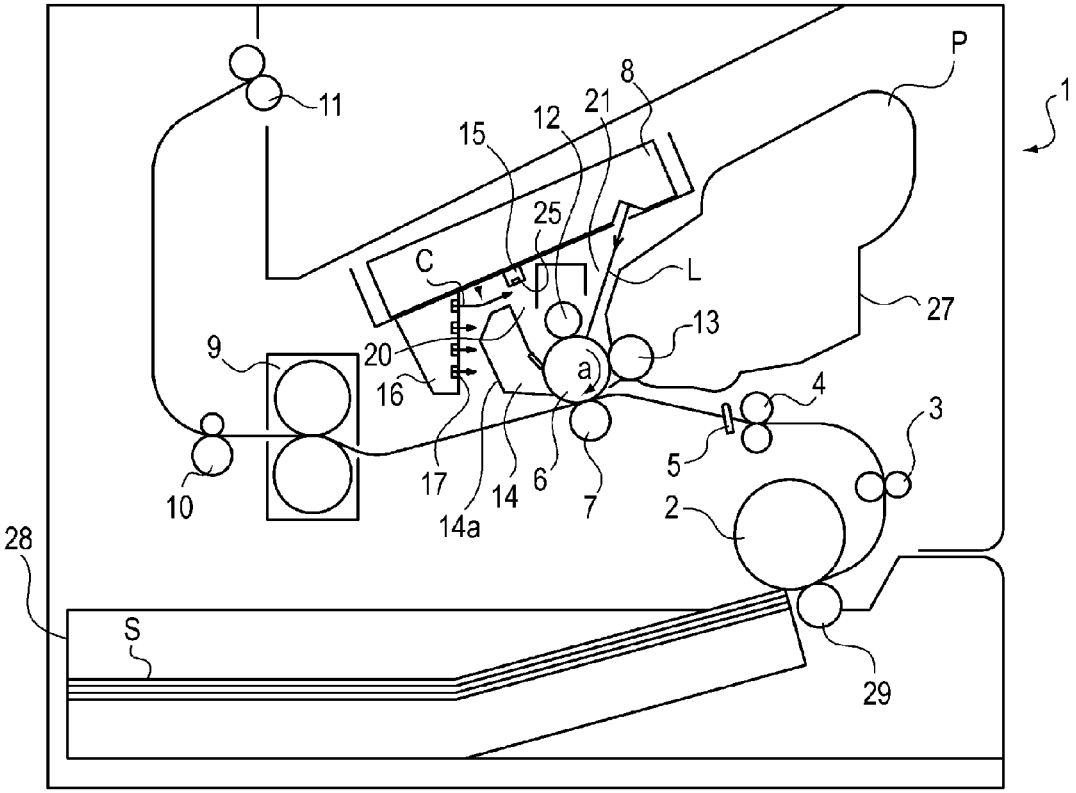
Fig. 15 (PRIOR ART)
FIG. 15 is a sectional view showing a structure from an image forming apparatus in Comparison Example.
Figure 16:
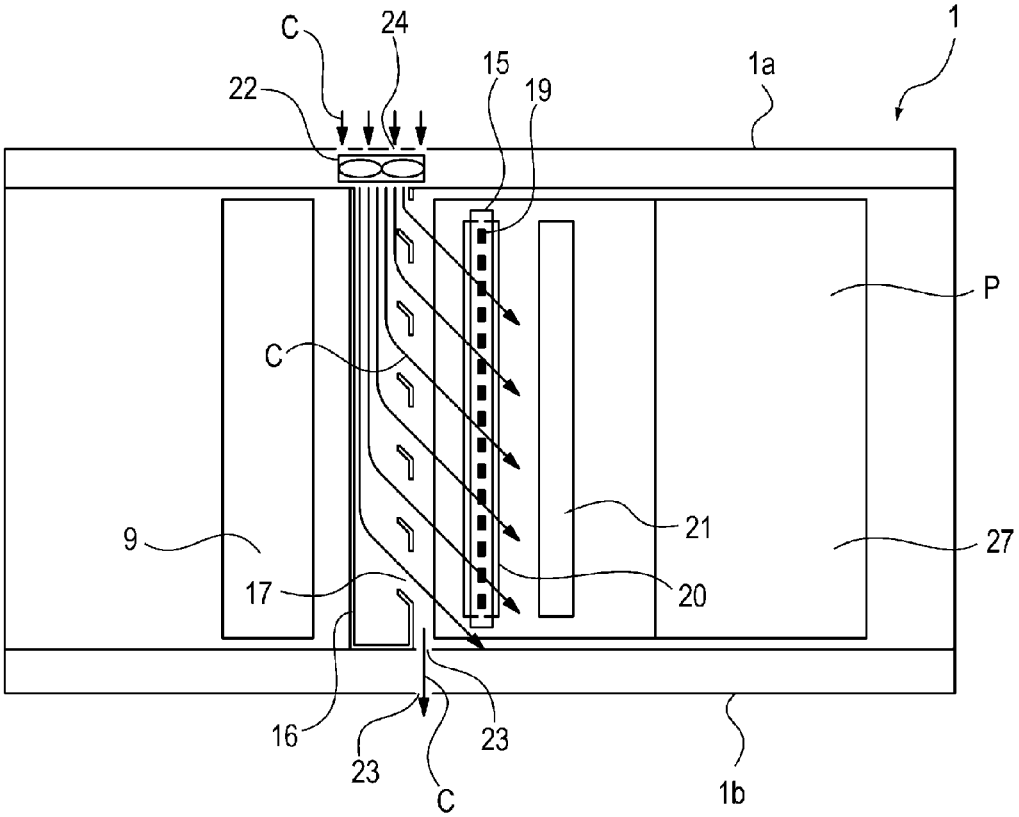
Fig. 16 (PRIOR ART)
FIG. 16 is a plan view showing the structure of the image forming apparatus in Comparison Example.

However, also in this embodiment, as shown in FIG. 13, in the state in which the process cartridge P is mounted in the main assembly of the image forming apparatus 1, the following effect is obtained. The part H1 of the warm air H sent from the fixing device 9 toward the process cartridge P is blocked by the outer peripheral wall surface 15*a* of the exposure device before charging 15, the cleaning member 18 and the outer peripheral wall surface 14*a* of the cleaning device 14 of the process cartridge P. Further, the part H1 of the warm air H sent from the fixing device 9 toward the process cartridge P does not reach the light emitting surface 25 of the exposure device before charging 15. As a result, the floating toner existing in the main assembly of the image forming apparatus 1 is prevented from being blown up in the air by the part H1 of the warm air H sent from the fixing device 9, so that the floating toner is not deposited on the light emitting surface 25 of the exposure device before charging 15.

As shown in FIG. 13, the cleaning member 18 in this embodiment is disposed so that the cleaning member 18 contacts the outer peripheral wall surface 15*a* of the exposure device before charging 15 and is superposed on (overlaps with) the light emitting surface 25. For this reason, the part H1 of the warm air H sent from the fixing device 9 is blocked by the cleaning member 18. Other constitutions are the same as those in Embodiments 1 to 4, and a similar effect can be obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 270657/2013 filed Dec. 27, 2013, which is hereby incorporated by reference.

What is claimed is:

1. An image forming apparatus for forming an image on a recording material, comprising:

a main assembly; and a cartridge, including an image bearing member, detachably mountable to said main assembly, wherein said main assembly includes:

an exposure device for exposing a surface of the image bearing member to light, said exposure device including a light emitting surface which emits light toward said surface of said image bearing member; and a fixing device for fixing a toner image transferred on the recording material, wherein said cartridge includes a windbreak portion projecting from said cartridge, and a width of said windbreak portion is wider than a width of said light emitting surface with respect to a longitudinal direction of said exposure device, and wherein said windbreak portion blocks air flow between said fixing device and said exposure device, and wherein said windbreak portion also functions as a first cleaning member for cleaning a light emitting portion of said exposure device in contact with said light emitting portion in a process in which said cartridge is mounted in said main assembly.

2. An image forming apparatus according to claim 1, wherein said first cleaning member includes a first cleaning portion and a second cleaning portion which are provided at different positions with respect to the longitudinal direction and with respect to a mounting direction of said cartridge.

3. An image forming apparatus according to claim 1, wherein said light emitting portion is covered with a transparent cover, and wherein a surface of said transparent cover toward said cartridge is subjected to antistatic treatment.

4. An image forming apparatus according to claim 1, wherein said first cleaning member is formed of an antistatic material.

5. An image forming apparatus according to claim 1, wherein said first cleaning member is formed of an electroconductive material.

6. An image forming apparatus according to claim 1, wherein said first cleaning member is formed of a foamed plastic material.

7. An image forming apparatus according to claim 1, wherein said first cleaning member is formed of a rubber material.

8. An image forming apparatus according to claim 1, wherein said first cleaning member is formed of a brush material.

9. An image forming apparatus according to claim 1, wherein said first cleaning member and said light emitting portion are provided so that longitudinal directions thereof cross each other.

10. An image forming apparatus according to claim 1, wherein said first cleaning member is formed in a zigzag shape along a longitudinal direction.

11. An image forming apparatus according to claim 1, further comprising an air sending mechanism, between said cartridge and said fixing device, for sending air toward said cartridge.

12. An image forming apparatus according to claim 1, further comprising, between said cartridge and said fixing device, a first opening and a second opening, wherein the first opening is provided in one side wall of said image forming apparatus, and the second opening is provided on the other side wall of said image forming apparatus, and wherein the first opening takes air into an inside of said main assembly and the second opening discharges the air from the inside of said main assembly.

13. An image forming apparatus according to claim 1, further comprising:

a charging member for electrically charging said image bearing member;

a second exposure device for forming a latent image on said image bearing member by exposing the image bearing member to light;

a developing device for developing the latent image to form a developer image on said image bearing member; and a transfer member for transferring the developer image from said image bearing member, wherein said exposure device is a pre-exposure device for exposing said image bearing member after the developer image is transferred from said image bearing member and before said image bearing member is charged by said charging member.

14. An image forming apparatus according to claim 13, further comprising a second cleaning member for removing a developer remaining on said image bearing member after the developer image is transferred from said image bearing member by said transfer member, wherein said exposure device is provided downstream of said second cleaning member with respect to a rotational direction of said image bearing member.

15. An image forming apparatus according to claim 1, wherein said main assembly includes a feeding mechanism for feeding the recording material, wherein said cartridge is mounted in said main assembly in a feeding direction of the recording material.

* * * * *